US005743506A

United States Patent [19]

Adams

[11] Patent Number: 5,743,506

[45] Date of Patent: Apr. 28, 1998

[54] CARPET PROTECTOR

[75] Inventor: William E. Adams, Butler County, Pa.

[73] Assignee: Adams Mfg. Corp., Portersville, Pa.

[21] Appl. No.: 576,514

[22] Filed: Dec. 21, 1995

Related U.S. Application Data

[63] Continuation-in-part of Ser. No. 38,078, Apr. 28, 1995, Pat. No. Des. 379,582, and a continuation-in-part of Ser. No. 38,084, Apr. 28, 1995, Pat. No. Des. 379,922, and a continuation-in-part of Ser. No. 38,637, May 10, 1995.

[51] Int. Cl.[6] ..... A47B 91/00

[52] U.S. Cl. ..... 248/346.11; D8/324

[58] Field of Search ..... 248/346.11, 501, 248/502, 523; D8/324

[56] References Cited

U.S. PATENT DOCUMENTS

| | | | |
|---|---|---|---|
| D. 114,551 | 5/1939 | Morgan . | |
| D. 120,409 | 5/1940 | Myers . | |
| D. 242,554 | 11/1976 | Flanagan . | |
| D. 361,505 | 8/1995 | Carioli . | |
| 1,559,827 | 11/1925 | Wittman | 248/346.11 |
| 1,903,690 | 4/1933 | Schacht | 248/346.11 |
| 1,912,728 | 6/1933 | Roc | 248/346.11 |
| 1,969,266 | 8/1934 | Herold | 248/346.11 |
| 2,301,385 | 11/1942 | Ehrgott . | |
| 2,944,366 | 7/1960 | Joabson | 248/346.11 |
| 3,138,893 | 6/1964 | Rupar | 248/346.11 |
| 5,362,024 | 11/1994 | Grinnen | 248/523 X |

FOREIGN PATENT DOCUMENTS

| | | | |
|---|---|---|---|
| 151495 | 5/1953 | Austria | 248/346.11 |
| 2062032 | 6/1971 | France | 248/346.11 |
| 2265314 | 2/1981 | France . | |
| 562589 | 3/1974 | Switzerland . | |
| 542788 | 1/1942 | United Kingdom . | |

*Primary Examiner*—Ramon O. Ramirez
*Attorney, Agent, or Firm*—Buchanan Ingersoll

[57] ABSTRACT

A carpet protector to support furniture and reduce damage to a carpet thereunder is provided. The carpet protector in accordance with the present invention generally includes a deformable receiving portion and a rigid base. The receiving portion preferably includes a plurality of ridges on an upper surface thereof to grip a furniture leg placed thereon. The base is configured to receive the lower surface of the receiving portion and includes a plurality of protrusions configured to extend into carpet on which the carpet protector is placed. The protrusions transfer and distribute the weight of the furniture to a base layer of the carpeting. The upper surface of the receiving portion preferably defines a concave surface to reduce slippage of the furniture leg upon the carpet protector.

17 Claims, 4 Drawing Sheets

CARPET PROTECTOR

RELATED APPLICATIONS

This application is a continuation-in-part of U.S. patent application, filed Apr. 28, 1995, and having Ser. No. 29/038,078 U.S. Pat. No. Des. 379,582; U.S. patent application, filed Apr. 28, 1995, and having Ser. No. 29/038,084 U.S. Pat. No. Des. 379,922; and U.S. patent application, filed May 10, 1995 and having Ser. No. 29/038,637.

BACKGROUND OF THE INVENTION

1. Field of the Invention

This invention pertains to carpet protectors, and more particularly to carpet protectors which include a base for engaging a carpet or rug and a receiving portion insertable within the base to reduce slippage of a furniture leg within such base.

2. Description of the Prior Art

It is well known that furniture legs may damage the pile surface of a carpet. The legs mat down and bend the pile fibers which may result in permanent depressions in the carpet if the furniture is left on the carpet for an extended period of time. These depressions are unsightly and often decrease the value of the carpet.

Many devices have been developed to alleviate the harmful effects of placing furniture upon the pile surface of a carpet. For example, the furniture support devices shown in U.S. Pat. No. 2,301,385, U.S. Pat. No. Des. 361,505, Swiss Patent No. 562,589, French Patent No. 2,265,314, generally include a circular member configured to engage a leg of a piece of furniture at an upper surface thereof.

These devices additionally include a plurality of protrusions which extend from the lower surface thereof and contact the lower layer of the carpet. The protrusions preferably transfer the weight of the furniture directly to the lower layer of the carpet without matting or bending the pile fibers. The weight is also distributed over a wider surface area.

However, a leg may slide on the upper surface of the circular member of these conventional devices if the weight of the furniture shifts. Specifically, tables, chairs, couches and other pieces of furniture may enjoy a certain degree of freedom on the upper surface of the conventional devices resulting in instability when the weight of the furniture shifts.

SUMMARY OF THE INVENTION

A carpet protector to support furniture and reduce damage to a carpet thereunder is provided. The carpet protector in accordance with the present invention generally includes a deformable receiving portion and a rigid base.

The receiving portion includes an upper surface and a lower surface. A furniture leg may be placed directly on the upper surface of the receiving portion. The upper surface may include a plurality of ridges or a plurality of pegs and preferably has a concave shape to reduce slippage of the furniture leg within the carpet protector.

The base also has an upper surface and a lower surface and the upper surface thereof is preferably configured to join the lower surface of the receiving portion. The lower surface of the base includes a plurality of protrusions. The protrusions are configured to extend into carpet on which the carpet protector is placed. The protrusions preferably transfer the weight of the furniture to a base layer of the carpet over a wide surface area.

The carpet protector may additionally include a securing portion to attach at least the receiving portion to the furniture leg. The securing portion may be placed between the receiving portion and the base and may include straps for attaching the receiving portion to the furniture leg.

The receiving portion may include an aperture for receiving a nail to secure the receiving portion of the carpet protector to the furniture leg.

A complete understanding of the invention may be obtained from the following description and the accompanying Figures.

DETAILED DESCRIPTION OF SOME PREFERRED EMBODIMENTS

Figure 1:
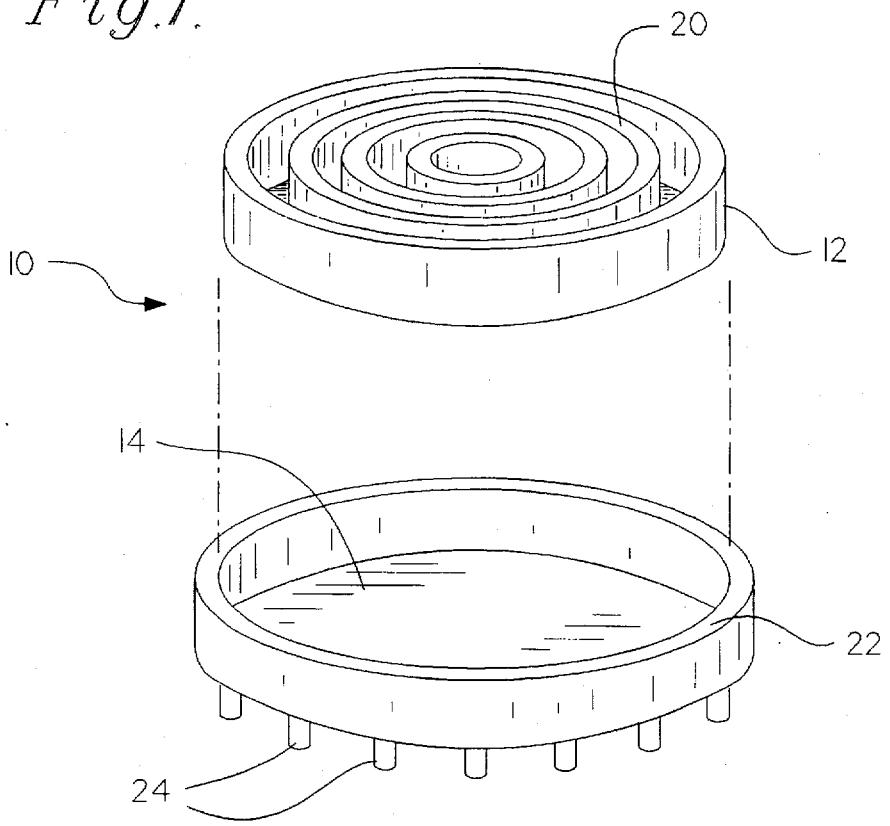
FIG. 1 is a perspective view of the receiving portion and base of the carpet protector in accordance with the present invention.

The carpet protector 10 in accordance with present invention may generally include two portions. A receiving portion 12 and base 14 are shown in FIG. 1. The receiving portion 12 is preferably formed to integrally fit within the base 14. The receiving portion 12 is configured to engage the leg 16 of a piece of furniture and the base 14 is configured to engage a carpet 18.

As shown in FIG. 1, the receiving portion 12 may be generally circular in shape. The receiving portion 12 may preferably be a soft, deformable material, such as polyvinyl chloride, such that the receiving portion 12 may deform and grip the leg 16 of a piece of furniture when the furniture leg 16 is placed upon the receiving portion 12 of the carpet protector 10. In particular, the receiving portion 12 may preferably have a durometer rating of between 50 and 80.

The base 14 may be formed of plastic which is preferably harder than the receiving portion 12. In particular, the rigid base 14 may be formed of polypropylene, styrene, polycarbonate, ABS types of resin, or compounds thereof, and is preferably slightly flexible. The receiving portion 12 and the base 14 may be clear.

Figure 2:
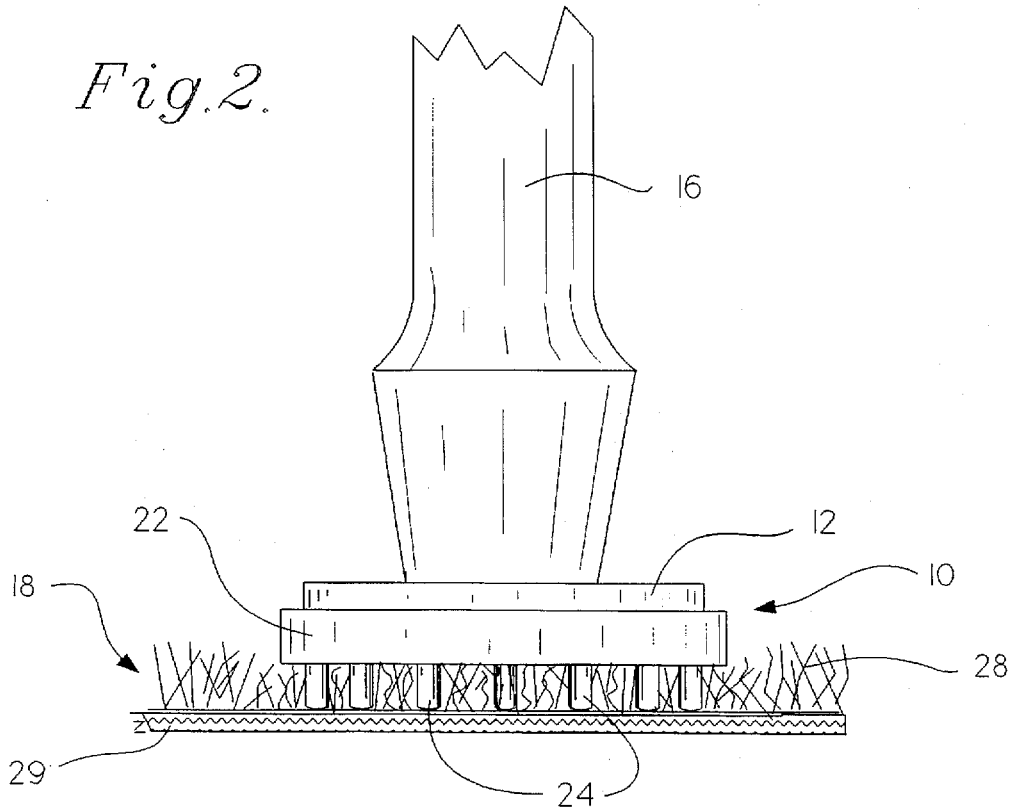
FIG. 2 an elevational view of the carpet protector of FIG. 1 on a carpet and supporting a furniture leg.

As shown in FIG. 2, a lower surface of the base 14 includes a plurality of protrusions 24 for conveying the weight of the furniture through an upper layer, such as a pile layer 28, to the base layer 29 of the carpet 18. The majority of the pile fibers under the carpet protector 10 are not exposed to the weight of the furniture and are therefore not matted or bent by the use thereof. FIG. 2 shows a plurality of protrusions 24 passing through a pile layer 28 and resting upon the base layer 29 of the carpet 18.

The length of the protrusions 24 may vary depending upon the type of carpet on which the furniture rests. In particular, short protrusions 24 having lengths of approximately ⅛" enable the carpet protector 10 to be utilized on floor coverings which have knots (e.g., oriental rugs). Protrusions 24 having longer lengths of approximately ¼" may preferably be utilized with pile or shag carpet 18.

The lower surface of the receiving portion 12 may be placed upon an upper surface of the base 14 when the carpet protector 10 is in use. The lower surface of the receiving portion 12 and the upper surface of the base 14 are preferably flat and engageable with one another. Including a flat upper surface on the base 14 provides a more even distribution of the weight of the furniture upon the carpet 18.

The base 14 may additionally include a raised edge 22 along the circumference or perimeter thereof and the receiving portion 12 may fit within the raised edge 22. The raised edge 22 of the base 14 preferably fittingly engages the outer edge of the receiving portion 12 when the carpet protector 10 is in use. A form fit between the receiving portion 12 and the base 14 is preferred to reduce slippage and movement of the receiving portion 12 within the base 14, and the furniture leg 16 resting upon the carpet protector 10 in general.

Figure 3:
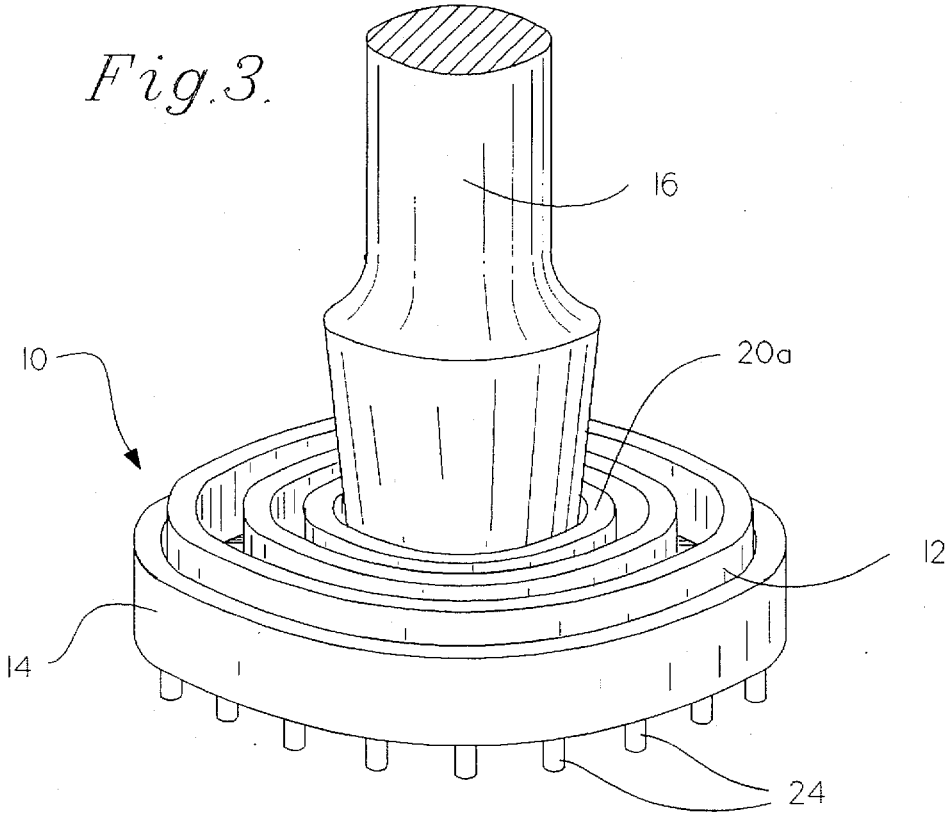
FIG. 3 is a perspective view of a furniture leg placed upon the carpet protector.

Referring to FIG. 1, a first embodiment of the receiving portion 12 of the carpet protector 10 may include a plurality of concentric ridges 20 on an upper surface thereof as shown. The furniture leg 16 is preferably placed on the center of the receiving portion 12 upon the innermost ridge 20*a* as shown in FIG. 3. The ridges 20 which engage the furniture leg 16 are compressed under the weight thereof and the ridges 20 firmly grip the leg 16.

The furniture leg 16 is firmly grasped by the receiving portion 12 and the receiving portion 12 may not move relative to the base 14 if the receiving portion 12 and base 14 are securely attatched or form fitted with one another. Therefore, sliding or slippage of the furniture leg 16 within the carpet protector 10 is greatly reduced despite a shifting of weight upon the furniture leg 16.

The plurality of concentric ridges 20 within the receiving portion 12 also act to evenly distribute the weight of the furniture upon the base 14, but in a minor way. The base 14 subsequently transfers the weight, via the plurality of protrusions 24, to the base layer 29 of the carpet 18. It follows that a substantial number of pile fibers remain undisturbed under the carpet protector 10.

Accordingly, the carpet protector 10 in accordance with the present invention not only reduces unsightly depressions within the pile layer 28 of the carpet, but also reduces slippage of the furniture leg 16 upon the carpet protector 10 as the weight imposed thereon shifts.

Figure 4:
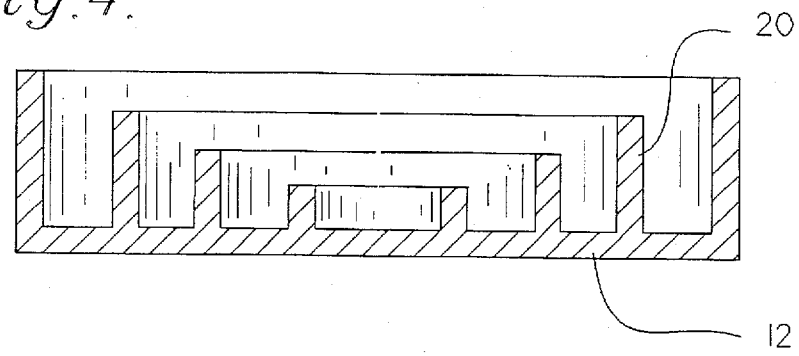
FIG. 4 is cross-sectional view of a second embodiment of the receiving portion of the carpet protector.

The receiving portion 12 of the carpet protector 10 may include a concave upper surface for receiving a furniture leg 16. Referring to the cross-sectional view of the receiving portion 12 shown in FIG. 4, the receiving portion 12 may include concentric ridges 20 of varying height on an upper surface thereof to define a concave surface.

In particular, the ridges 20 of the receiving portion 12 preferably progressively decrease in height from the outer edge thereof to the center. The ridges 20 define a concave upper surface to engage the furniture leg 16. Providing a concave upper surface on the receiving portion 12 is preferred inasmuch as the gripping ability of the receiving portion 12 is improved thereby. It follows that slippage of the furniture leg 16 may be reduced within a carpet protector 10 having a receiving portion 12 with a concave upper surface.

Figure 5:
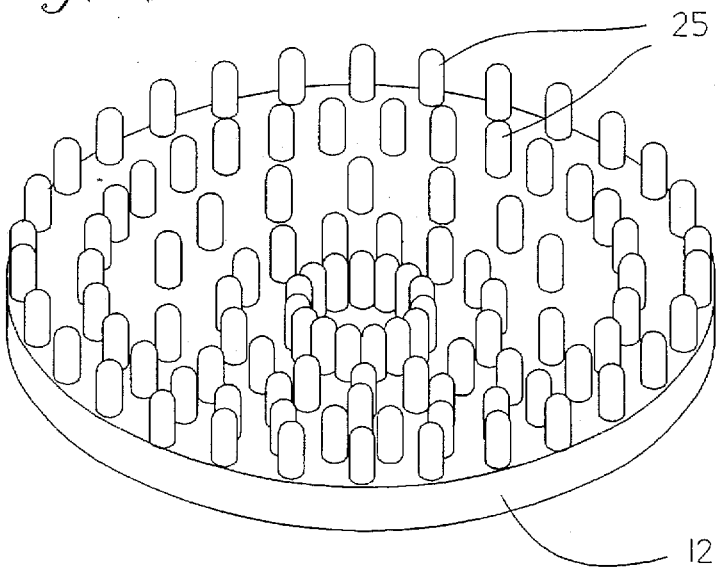
FIG. 5 is a perspective view of a third embodiment of the receiving portion of the carpet protector.
Figure 6:
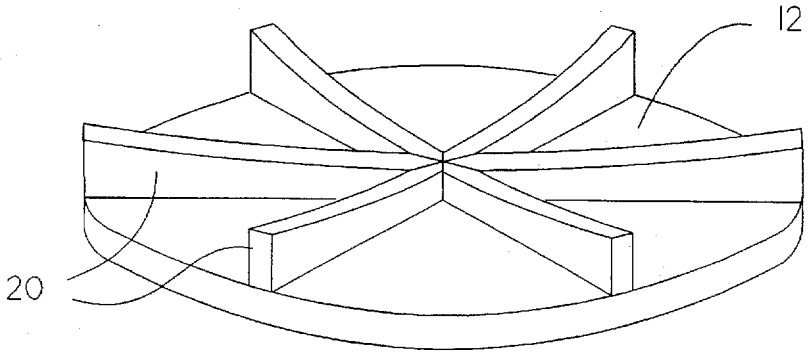
FIG. 6 is a perspective view of a fourth embodiment of the receiving portion of the carpet protector.

Alternatively, the upper surface of the receiving portion 12 may include a plurality of pegs 25 as shown in FIG. 5 or a plurality of straight ridges 20 as shown in FIG. 6 to receive a furniture leg. The pegs 25 and straight ridges 20 may define a concave upper surface. The straight ridges 20 preferably intersect at the center of the receiving portion 12. The straight ridges 20 and the pegs 25 may decrease in height from the outer edge to the center of the receiving portion 12.

Similar to the concentric ridges 20, the straight ridges 20 and pegs 25 are preferably soft, deformable material to increase the gripping ability of the receiving portion 12 of a furniture leg 16. The portions of the straight ridges 20 and pegs 25 under the furniture leg 16 may, and usually will be deformed by the weight of the furniture thereon.

The ridges 20 may be formed in any alternative arrangement on the upper surface of the receiving portion 12 to reduce slippage of the furniture leg 16 upon the carpet protector 10. In addition, alternative methods of forming a concave upper surface on the receiving portion 12 are encompassed within the scope of the carpet protector 10 in accordance with the present invention.

Figure 7:
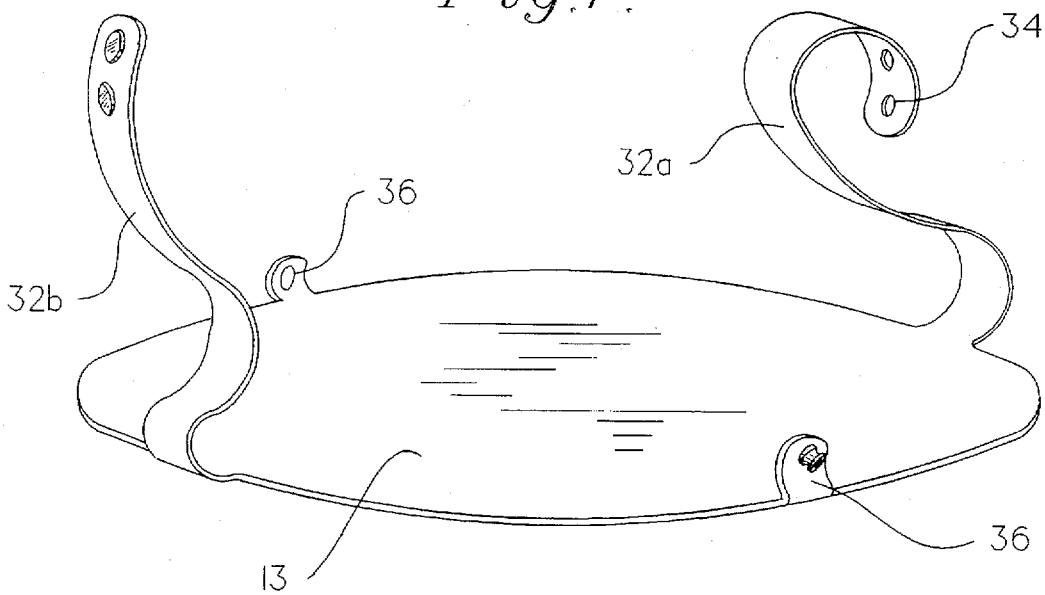
FIG. 7 is a perspective view of a securing portion which may be interposed between the receiving portion and base of the carpet protector.

The carpet protector 10 may additionally include a securing portion 13 which may be inserted between the lower surface of the receiving portion 12 and the upper surface of the base 14. Referring to FIG. 7, the securing portion 13 is preferably a flexible plastic which has flat upper and lower surfaces for engagement with the receiving portion 12 and the base 14.

The securing portion 13 may additionally include at least one strap 32 for attaching the securing portion 13 and receiving portion 12 of the carpet protector 10 to the furniture leg 16. The straps 32 may be molded into the securing portion 13 or attached thereto. Alternatively, the straps 32 may be molded into the receiving portion 12 or attached thereto.

Figure 8:
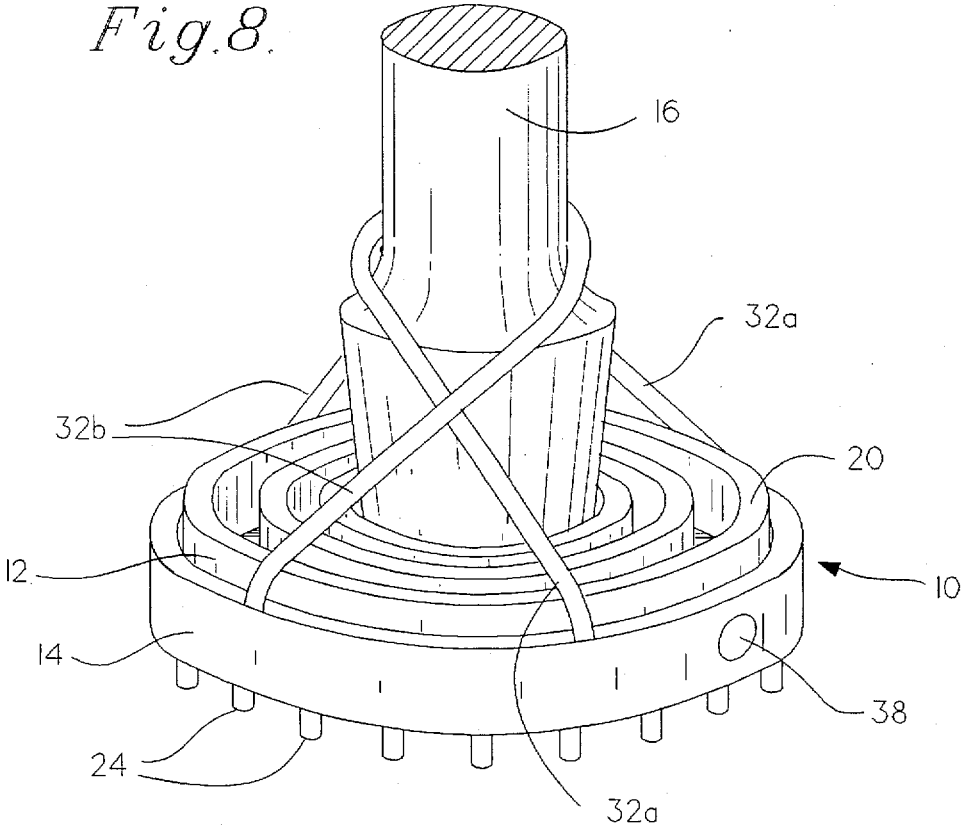
FIG. 8 is a perspective view of the securing portion of FIG. 7 securing the carpet protector to the furniture leg.

As shown in FIG. 8, the straps 32*a*, 32*b* may be wrapped around the furniture leg 16 for securely attaching the securing portion 13 and receiving portion 12 thereto. The free ends of the straps 32*a*, 32*b* may contain a plurality of holes 34 which are engageable with two nubs 36 on the receiving portion 12, securing portion 13, or base 14. The straps 32*a*, 32*b* are preferably wrapped about the furniture leg 16 and the holes 34 and nubs 36 permit the straps 32*a*, 32*b* to be secured in a fixed position.

Alternatively, the straps 32 may be utilized to attach the receiving portion 12, securing portion 13 and base 14 to the furniture leg 16. In particular, the straps 32 may be inserted through holes 38 within the raised edge 22 of the base 14 and around the furniture leg 16 and fixed to the nubs 36.

The straps 32 may additionally be wrapped around the furniture leg 16 and the nubs 36 may be inserted into the holes 38 of the raised edge 22 of the base 14 to attach the receiving portion 12, securing portion 13 and base 14 to the furniture leg 16.

Other fixing and attachment devices known in art may be utilized to secure the straps 32 in a fixed position about the furniture leg 16.

Figure 9:
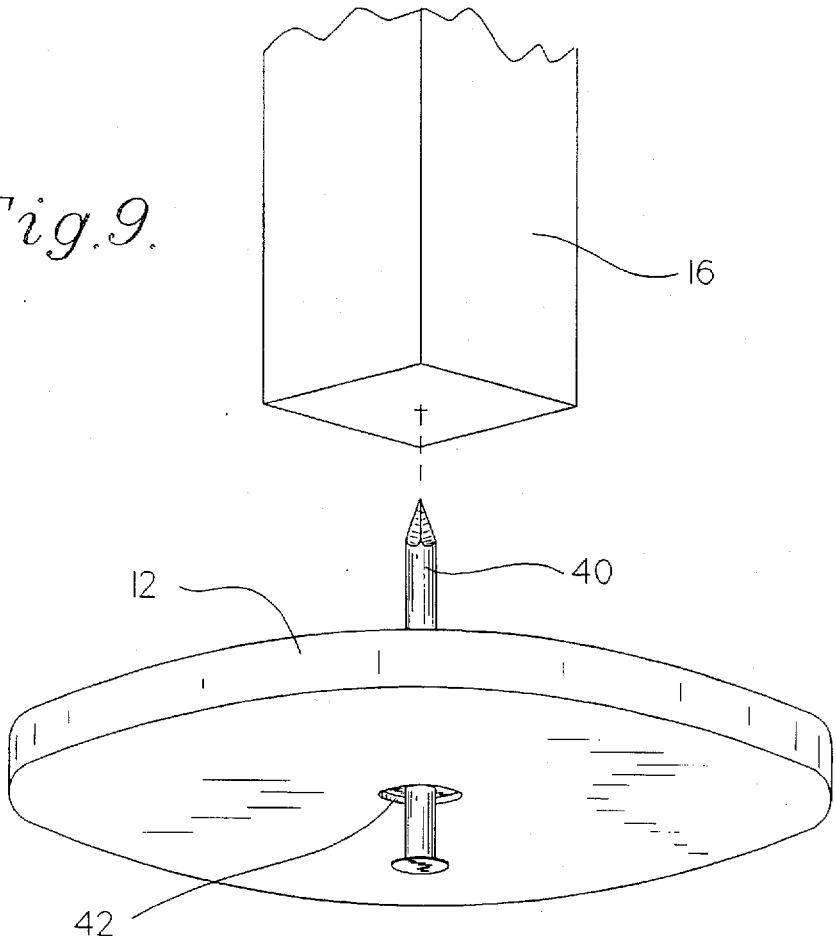
FIG. 9 is an exploded view of the receiving portion of the carpet protector and a nail for securing the receiving portion to a furniture leg.

Referring to FIG. 9, the receiving portion 12 may include an aperture 42 through the center thereof. A nail 40, or a similar elongated securing device such as a screw, may be inserted through the aperture 42 of the receiving portion 12 and into the furniture leg 16 to secure the receiving portion 12 thereto. The aperture 42 may be countersunk to accept the head of the nail 40. The aperture may be in base, 14, as well.

Securely attaching the receiving portion 12 to the furniture leg 16 further reduces the amount of slippage of the furniture leg 16 within the carpet protector 10.

While preferred embodiments of the invention have been shown and described herein, it will be appreciated by those skilled in the art that various modifications and alternatives to the disclosed embodiments may be developed in light of the overall teachings of the disclosure. Accordingly, the disclosed embodiments are meant to be illustrative only and not limiting to the scope of the invention which is to be given the full breadth of the following claims and all equivalents thereof.

I claim:

1. A carpet protector to support furniture and reduce damage to a carpet, comprising:

a. a rigid base having an upper surface and a lower surface and the lower surface of said base having a plurality of protrusions attached thereto and extending away therefrom; the protrusions being configured to extend into and engage the carpet on which said base is placed; and b. a deformable receiving portion having an upper surface and a lower surface wherein:

i. the upper surface of said receiving portion includes a plurality of ridges on which a furniture leg is placed;

ii. the lower surface of said receiving portion is engageable with the upper surface of said base; and iii. said receiving portion will deform when a furniture leg is placed on the upper surface thereof and conform to the furniture leg.

2. The carpet protector of claim 4 wherein said base is polycarbonate and said receiving portion is one of polyvinyl chloride, polypropylene, styrene, ABS based resin and compounds thereof.

3. The carpet protector of claim 1 wherein said receiving portion includes an aperture to receive a nail for securing said receiving portion to the furniture leg.

4. The carpet protector of claim 1 wherein the ridges define a concave surface.

5. The carpet protector of claim 1 wherein the ridges include a plurality of concentric circles.

6. The carpet protector of claim 1 wherein the ridges intersect at a center of said receiving portion.

7. The carpet protector of claim 1 wherein said base includes a raised edge along a perimeter thereof.

8. The carpet protector of claim 1 wherein the upper surface of said base and the lower surface of said receiving portion are flat.

9. The carpet protector of claim 1 wherein said receiving portion has a durometer rating between 50 and 80.

10. A carpet protector to support furniture and reduce damage to a carpet, comprising:

a. a rigid base having an upper surface and a lower surface and the lower surface of said base having a plurality of protrusions attached thereto and extending away therefrom, the protrusions being configured to extend into and engage the carpet on which said base is placed; and b. deformable receiving portion having an upper surface and a lower surface wherein:

i. the upper surface has a plurality of pegs on which a furniture leg is placed and wherein the pegs define a concave surface, ii. the lower surface of said receiving portion being engageable with the upper surface of said base, and iii. said receiving portion will deform when a furniture leg is placed on the upper surface thereof and conform to the furniture leg.

11. A carpet protector to support furniture and reduce damage to a carpet comprising:

a. a rigid base having an upper surface and a lower surface and the lower surface of said base having a plurality of protrusions attatched thereto and extending away therefrom; the protrusion being configured to extend into and engage the carpet on which said base is placed and said base includes a raised edge along a perimeter thereof; and b. a deformable receiving portion having upper surface and a lower surface wherein:

i. the upper surface of said receiving portion includes a plurality of concentric ridges which define a concave surface;

ii. the lower surface of said receiving portion is engageable with the upper surface of said base; and iii. said receiving portion will deform when a furniture leg is placed on the upper surface thereof and conform to the furniture leg.

12. A carpet protector to support furniture and reduce damage to a carpet, comprising:

a. a rigid base having an upper surface and a lower surface and the lower surface of said base having a plurality of protrusions attached thereto and extending away therefrom, the protrusions being configured to extend into and engage the carpet on which said base is placed;

b. a deformable receiving portion having an upper surface and a lower surface, wherein the lower surface of said receiving portion is engageable with the upper surface of said base and said receiving portion will deform when a furniture leg is placed on the upper surface thereof and conform to the furniture leg; and c. a securing portion connected to at least one of said base and said receiving portion to secure said receiving portion to the furniture leg.

13. The carpet protector of claim 12 wherein said securing portion includes at least one strap.

14. The carpet protector of claim 12 wherein the upper surface of said receiving portion is concave.

15. The carpet protector of claim 12 wherein the upper surface of said receiving portion includes a plurality of ridges on which the furniture leg is placed.

16. The carpet protector of claim 15 wherein the ridges define a concave surface.

17. The carpet protector of claim 15 wherein the ridges include a plurality of concentric circles.

* * * * *